US005992760A

United States Patent [19]

Kearby et al.

[11] Patent Number: 5,992,760

[45] Date of Patent: Nov. 30, 1999

[54] IMPACT SPRINKLER UNIT

[75] Inventors: Don Michael Kearby, Vista; Giles A. Kendall, Claremont; Joseph U. Han, Rancho Cucamonga; Derick C. Wright, Pleasanton, all of Calif.

[73] Assignee: Virtual Rain, Inc., Pleasanton, Calif.

[21] Appl. No.: 09/128,269

[22] Filed: Aug. 2, 1998

[51] Int. Cl.[6] ..... B05B 15/10

[52] U.S. Cl. ..... 239/205; 239/200; 239/206; 239/231; 239/232; 239/255

[58] Field of Search ..... 239/200–206, 239/231, 232, 251, 255, 230

[56] References Cited

U.S. PATENT DOCUMENTS

| | | | |
|---|---|---|---|
| 3,602,431 | 8/1971 | Lockwood | 239/101 |
| 3,765,608 | 10/1973 | Lockwood | 239/230 |
| 3,930,617 | 1/1976 | Dunmire | 239/230 |
| 4,055,304 | 10/1977 | Munson | 239/230 |
| 4,103,828 | 8/1978 | Ridgway | 239/206 |
| 4,164,324 | 8/1979 | Bruninga | 239/230 |
| 4,182,494 | 1/1980 | Wichman et al. | 239/230 |
| 4,432,495 | 2/1984 | Bruninga | 239/205 |
| 4,773,595 | 9/1988 | Livne | 239/203 |
| 4,796,809 | 1/1989 | Hunter | 239/205 |
| 5,765,757 | 6/1998 | Bendall | 239/205 |

*Primary Examiner*—David J. Walczak
*Assistant Examiner*—Tuan Nguyen
*Attorney, Agent, or Firm*—Wilson Sonsini Goodrich & Rosati

[57] ABSTRACT

A sprinkler device for distributing water comprising a body, a nozzle, a nozzle housing rotatably and slidably mounted in the body, a fluid flow interrupter for intermittently redirecting the stream of fluid exiting from the nozzle, an interrupter drive, a flow control assembly including a free floating valve for controlling water flow to the sprinkler head, reversing mechanism for reversing the direction of movement of the nozzle housing, and a nozzle positioning system for controlling sprinkler rotation speed.

17 Claims, 16 Drawing Sheets

IMPACT SPRINKLER UNIT

BACKGROUND OF THE INVENTION

1. Field of the Invention

The present invention relates to irrigation sprinklers, in general, and to an improved impact sprinkler unit, in particular.

2. Prior Art

Many regions of the world today use irrigation systems for the artificial distribution of water. One of the most widely used irrigation systems, particularly where water is not abundant or plentiful, is the sprinkler system wherein one or more sprinkler units are positioned about a land area for distributing water over the surface of the land area. Such systems are widely used in most developed countries for lawns, golf courses, playing fields and many field crops.

Impact sprinklers, in general, are well known in the art. Such sprinklers have been used for many years. Impact sprinklers are, generally, of two broad varieties or types. The first type is the open or common riser mounted sprinkler which is merely attached to the end of a riser stem or pipe formed by a water conduit. The second type is a similar sprinkler unit which is mounted within a housing which is, in turn, frequently buried beneath the surface of the ground so that the sprinkler is a "pop-up" unit.

The first type of sprinkler is most often used in open areas such as flower beds or the like which do not require close trimming, for example by a lawnmower of the like. These units extend upwardly from the surface and are somewhat obtrusive and unattractive. Consequently, they are used in areas where they are not readily observed.

The second type of sprinkler is most often used in lawn settings and is mounted within housings (or wells) which are buried underground. The top of the housing is substantially flush with the surface which can be easily mowed. The sprinklers, per se, are arranged to "pop-up" (or rise above the housing and the ground surface) when water is supplied. In this fashion, the sprinklers remain out of sight until activated.

However, the housings for this type of sprinkler, being open by design to accomodate the standard impact sprinkler arm, tend to become filled with debris such as dirt, grass clippings and the like. Any of the above hamper the ability of the sprinkler to pop-up, to retrace and the arm's ability to drive the sprinkler.

Also, known in the art are gear driven sprinklers wherein the nozzle is, effectively, rotated by a gear driving mechanism which is activated by the water applied to the sprinkler. These sprinklers have the advantage that their housings are closed by nature avoiding the open or well design of an impact sprinkler. However, it has been determined that these sprinklers are frequently subject to failure due to debris becoming engaged in the gear drive mechanism. As a consequence, a new design of sprinklers is needed.

PRIOR ART STATEMENT

Listed herewith are patents relating to sprinkler units known in the art and which were discovered in a patentability search.

U.S. Pat. No. 3,602,431: A SPRINKLER DEVICE FOR FLUID DISTRIBUTION; Lockwood. This patent is directed to a sprinkler for distributing water comprising a body, a sprinkler head rotatably connected to the body, a fluid flow interrupter for providing controlled bursts of fluid in the stream of fluid exiting from the sprinkler head, an interrupter drive, a drive means including a free rotating ball for driving the sprinkler head, and reversing means for reversing the direction of movement of the sprinkler head.

U.S. Pat. No. 3,765,608: AUTOMATIC INTERMITTENT BREAK-UP DEVICE; Lockwood. This patent is directed to a sprinkler with an automatic intermittent break-up device repeatedly movable toward the center of the fluid stream exiting a nozzle to a first position to increase the break-up of the stream and movable away from the center of the fluid stream exiting the nozzle to a second position to decrease the break-up to provide more desired distribution of fluid on the surface area.

U.S. Pat. No. 3,930,617: IMPACT SPRINKLER; Dunmire. This patent is directed to an impact sprinkler which uses a plastic water deflector having a number of cooperating water deflecting surfaces which improve the overall water distribution pattern of the sprinkler; the particular configuration provided for allowing the water deflector to pivot back and forth.

U.S. Pat. No. 4,055,304: AUXILIARY BRAKING MEANS FOR IMPACT ARM SPRINKLERS; Munson. This patent is directed to an impact type rotary sprinkler including a rotatable body and nozzle, an impact arm which oscillates responsive to the kinetic energy of the fluid discharge stream and a primary spring which stores the rotational energy of the oscillating arm rotating to impact against the housing and impart an increment of rotation thereto.

U.S. Pat. No. 4,103,828: ROTARY SPRINKLER IMPACT ARM SPRING ADJUSTMENT; Ridgway. This patent is directed to a rotary sprinkler with structure for adjusting the force applied to the impact arm by the impact arm spring, viz. a laterally directed nozzle cooperating with the arm to rotate the nozzle and an impact arm journaled on a shaft extending above the nozzle. The arm is mounted within a cage extending above the nozzle.

U.S. Pat. No. 4,164,324: SPRINKLER HEAD WITH IMPROVED INTEGRAL IMPACT ARM AND ANTI-BACKSPLASH DRIVE SPOON; Bruninga. This patent is directed to a part-circle rotary sprinkler head having an improved anti-backsplash drive spoon integrally formed as a part of the impact arm.

U.S. Pat. No. 4,182,494: ANTI SIDE SPLASH DRIVE ARM FOR AN IMPACT DRIVE SPRINKLER; Wichman. This patent is directed to an impact sprinkler of the full or part circle type with an anti side splash drive arm.

SUMMARY OF THE INSTANT INVENTION

It is a primary object of the present invention to provide an impact sprinkler unit of improved design which uses a closed case pop-up design.

The instant invention relates to a sprinkler unit with an inner and an outer housing which are slidably mounted relative to each other. The unit also includes a central shaft which is slidably mounted within the inner housing. The outlet nozzle is mounted in a turret provided on the upper end of the central shaft. The unit includes a filter for filtering the water which is applied through the unit and an inner valve means in a main through-passage for impeding flow of water through the sprinkler unit until upon pop-up, the impact arm is completely clear of the body housing. On retraction, the inner valve stops the flow of water, allowing the arm to move into the turret, prior to the inner housing moving back into the outer housing. The unit is designed to enable uniform speed of rotation of the turret with different nozzles and different flow rates, as well as ease of installation and removal for service.

DESCRIPTION OF A PREFERRED EMBODIMENT

Figure 1:
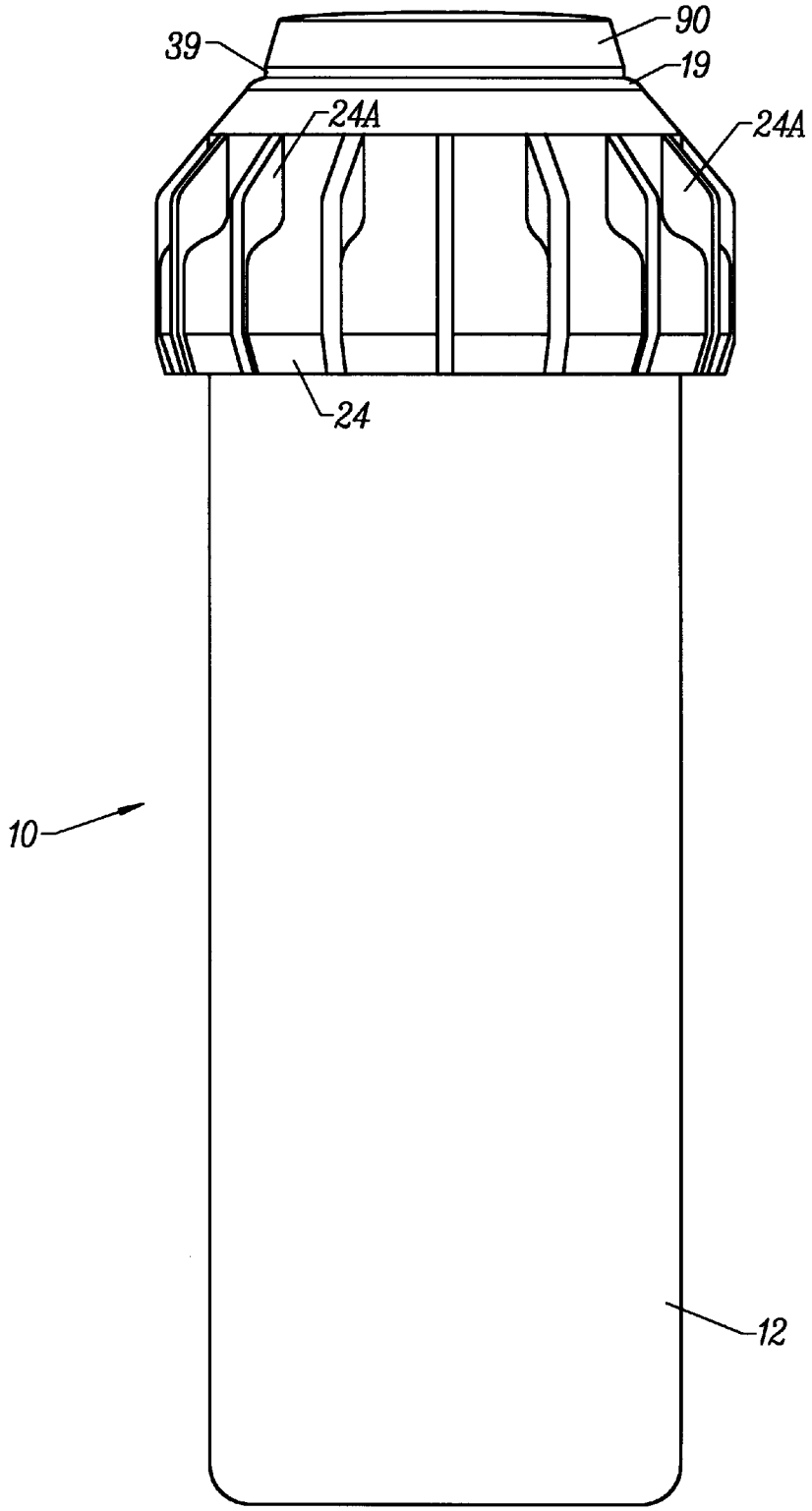
FIG. 1 is an external view of one embodiment of the sprinkler unit of the instant invention in the closed (non-operating) position.

Referring now to FIG. 1, there is shown an external view of the sprinkler unit 10 of the instant invention in the closed, non-operating (or quiescent) condition. The unit 10 includes an outer housing 12 which is, in this embodiment, generally cylindrical in configuration. The housing 12 is, typically, fabricated of ABS plastic or the like.

A retaining cap 24 is threadedly attached to the housing 12 as described infra. The cap incudes a plurality of flanges 24A (or similar gripping means) to facilitate handling of the cap 24 when it is to be engaged to, or disengaged from, the housing 12.

A protective cap cover 90 (which may be optional in some embodiments) is attached to the turret cover 39 as described hereinafter.

A wiper seal 19 (as described infra) is retained in the unit 10 by the retaining cap 24. The wiper seal substantially surrounds the turret 40 (see FIG. 3) which is slidably mounted therein.

Figure 2:
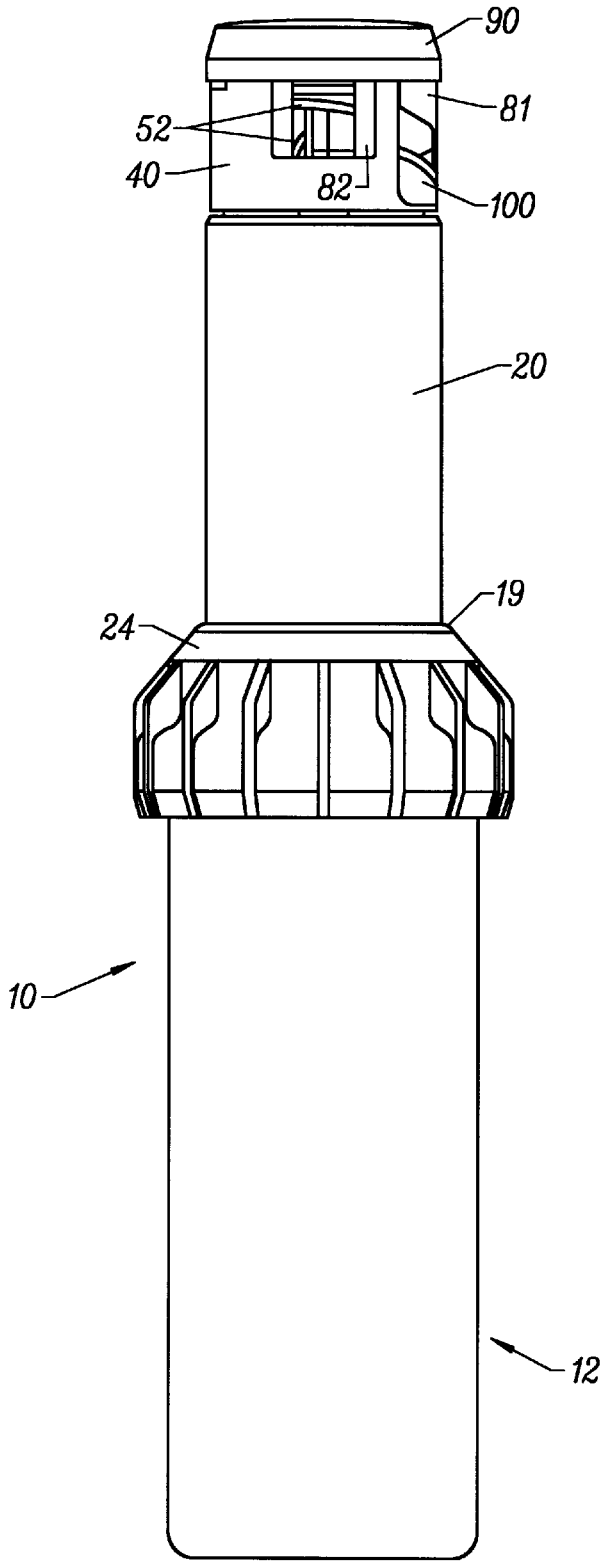
FIG. 2 is an external view of the sprinkler unit shown in FIG. 1 in the open (operating) position.

Referring now to FIG. 2, there is shown the external view of the sprinkler unit 10 in the operating condition. In this condition, the turret 40 is extended above the cap 24 and the unit 10 is in condition to spray water therefrom.

In this view, the wiper seal 19 snugly, but slidably, surrounds the inner housing 20 which has been pushed upwardly out of the outer housing 12 by the application of pressurized water (or the like) through the input at the lower end of the housing 12 as described hereinafter.

The turret 40 (with cover 90 thereon) includes an opening 82 in the peripheral wall through which the water from the nozzle 52 within the turret exits. The turret 40 also includes an opening 81 in the peripheral wall through which the impact arm 100 extends when the unit 10 is operational.

Figure 3:
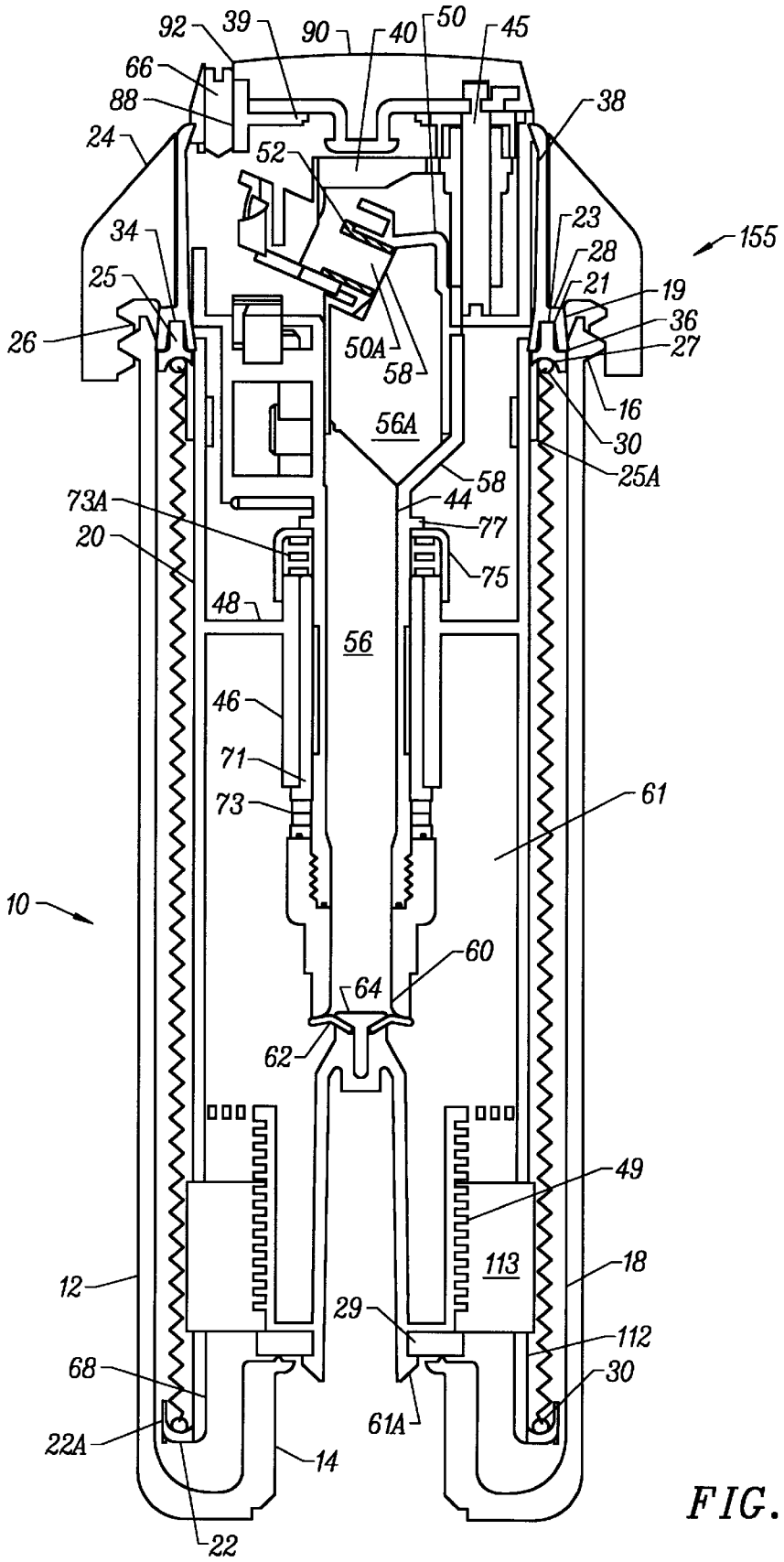
FIG. 3 is a cross-sectional view of a preferred embodiment of the invention in the closed position.

Referring now to FIG. 3, there is shown a cross-sectional view of a sprinkler unit 10 embodying the present invention. The sprinkler unit 10 comprises an outer housing 12 having a threaded inlet 14 at one end for threadably mounting the unit 10 to a riser or other suitable connection to a source of pressurized water (not shown). The housing 12 has an upper end which includes external threads which cooperate with internal threads of the retaining cap 24 for retaining the axially extensible inner housing 20 within the housing 12.

One or more ribs 18 are formed on the inner surface of the housing 12 to aid in guiding and orienting the inner housing 20 within the outer housing 12. The housing 20 includes a radially extending flange 22 at the lower end thereof. The flange 22 includes one or more grooves 22A in the periphery through which slidably engage the ribs 18. As a result, the inner housing 20 is slidably, but not rotatably, mounted within the outer housing 12. Of course, it should be understood that the ribs and grooves can be reversed in respective locations.

In a preferred embodiment, a filter 49 is connected to one end of the inner housing 20 and slidably movable therewith. In one embodiment, the filter 49 takes the form of a basket which readily passes water therethrough but which captures particulate matter, such as, but not limited to, sand, grass and the like. Thus, this debris does not enter the internal components of the unit to cause blockage or the like. The filter 49, typically, includes at least one guide 113 in at least a portion of the side thereof to engage groove 112 formed in the surface of inner housing 20 in order to prevent rotation of the filter 49 and to control the movement of the filter within the housing 12. Thus, the filter 49 is slidably, but not rotatably, mounted to the inner housing 20.

The filter 49 includes valve stem 61 which extends vertically through the center thereof. A conically shaped valve seat 62 formed of deformable material such as hard rubber of the like, is attached to the upper end of valve stem 61 by a seal retainer 64. The retainer 64 is, typically, threadedly attached or friction fitted to the valve stem 61.

It will be seen that seat 62 cooperates with inlet cap 60 to prevent water passage until the filter 49 is stopped by limit arm 25A (see infra) whereupon the valve opens, i.e. inlet cap 60 is disengaged from seat 62, and permits water flow therethrough.

A check valve is formed by mounting a suitable washer or gasket at the under side of filter 49. The gasket 29 is maintained in place by the fingers 61A which extend from the lower end of valve stem 61 and below the lower surface of filter 49.

The inner housing 20 is retained within the bore of the outer housing 12 by the retaining cap 24. As noted supra, cap 24 has internal threads 26 which threadedly engage threads 16 on the outer surface of the outlet end of the outer housing 12. The cap 24 includes an interior annular shoulder 28 which captures and retains the wiper seal 19 which is mounted within the central opening of cap 24.

The wiper seal 19 has a central bore 38 through which the inner housing 20 selectively extends and retracts. The wiper seal 19 includes a seat 34 in the form of an annular rim formed on the outer surface of seal 19. The seat 34 is captured by the internal shoulder 28 of cap 24. Adjacent to the seat 34, the seal 19 includes an inner lip 36 which slidably engages the under surface of the inner housing 20. The lip 36 provides a seal against water leakage around the inner housing 20.

The seat 34 includes an annular groove 21 at the lower (or interior) end thereof. The groove 21 captures and retains a lip 23 which projects upwardly from a spring retainer 25 which includes an annular groove 27 or channel to capture and retain the upper end of elongated compression spring 30. Thus, spring 30 is positional between radial flange 22 at the lower end of inner housing 20 and annular groove 27 in spring retainer 25 at the upper end thereof. As will be seen, the spring 30 is compressed when the inner housing 20 is moved upwardly within housing 12 when water is applied to the unit 10.

The retainer 25 includes an elongated leg 25A which extends downwardly therefrom and slidably engages the outer surface of inner housing 20. Thus, the retainer 25 functions as a guide for housing 20. The lower end of elongated leg 25A also acts as an upper limit stop which engages the guide 113 of filter 49 as it is moved upwardly. As will be seen, when the leg 25A (or limit stop) limits the upward movement of the filter screen 49, the central shaft 44 continues to move upwardly with inner housing 20, which, effectively, causes internal valve to open when inlet cap 60 becomes disengaged from valve seat 62.

Mounted within the inner housing 20 is a rotatable turret assembly 135 which includes the turret 40 mounted on the partially conical member 58 at the upper end of an elongated, central hollow shaft 44 which is rotatably mounted in a support channel 46 joined to the inner surface of inner housing 20 by an annular shoulder 48. As will be described hereinafter, the shoulder 48 is instrumental in the movement of the inner housing 20 upwardly when water (or other fluid) applies pressure thereto.

The turret 40 in the illustrated embodiment is covered by a circular turret cap 39 which has an aperture or opening 88 through which the radius adjusting screw 66 extends. A protective cover 90, typically, hard rubber, santoprene or the like, is mounted over the cap 39 and includes opening 92 for access to the radius adjusting screw 66, as illustrated.

A pressed-on bearing 71 is mounted on the mid-portion of shaft 44. The bearing 71 permits the shaft 44 to rotate smoothly and easily in the cylindrical support channel 46. An inlet cap 60 is threadedly attached to the lower end of central shaft 44. A bearing stack 73 is disposed around the shaft 44 intermediate the inlet cap 60 and the bearing 71. Spring 73A applies a load between support channel 46 and thrust load bearing 75 whereby the inlet cap 60 is continuously vertically loaded. Typically, the bearing stack 73 has a number of separate annular bearings (or washer-like) components of different hardnesses and frictional characteristics in order to facilitate rotation of shaft 44 without binding or the like.

A thrust load bearing 75 is cup-shaped with a hole therethrough to accomodate shaft 44. An annular shoulder 77 on shaft 44 rests upon bearing 75. The edges of bearing 75 slidably and rotatably engage the upper end of support channel 46 that restricts the flow of debris into the upper portion of bearing 71.

A tool-coupling slot 80, which may be in the form of a screwdriver slot or a hex key-like slot for receiving a tool for rotating the radius reduction screw 66, is formed in the upper end of the actuating member.

The overall housing forms a flow passage between inlet 14 and an outlet 50A in which is detachably mounted in nozzle assembly 50. Check valve 29 at the lower end of the inner housing 20 selectively opens to permit the flow of water through the filter 49, a through bore 56 in central shaft 44 with an outlet portion extending upward and outward at an angle in the head 40. Alternatively, check valve 29 prevents fluid backflow in the passage-way.

When pressurized water is not supplied to the sprinkler unit, the valve seat 62 and valve 29 are in the closed position, as shown in FIG. 1. In this case, the sprinkler unit 10 is fully closed, with the valves closing off the passage and, thus, the potential flow of water into or out of the nozzle 52.

Figure 5:
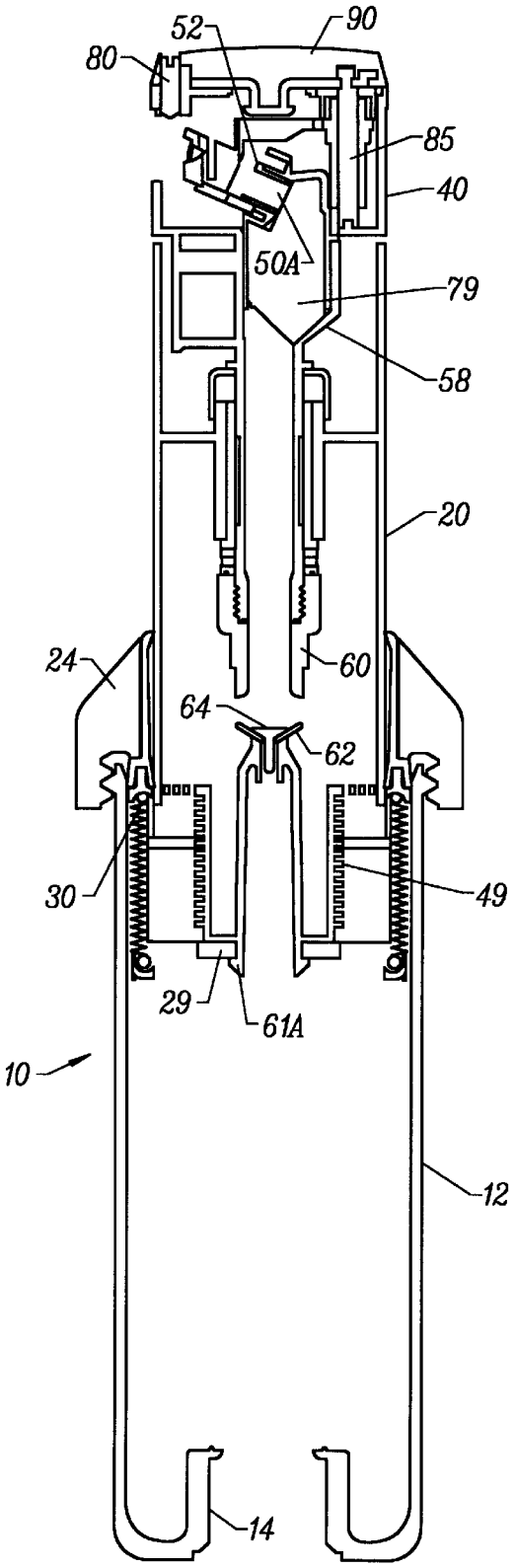
FIG. 5 is a cross-sectional view of the embodiment shown in FIG. 3 in the open position.

In operation, the valve member is in the fully opened position as shown in FIG. 5. When flow to the sprinkler unit 10 is to be stopped, the flow of water through the housing is turned off by the operator.

Figure 4:
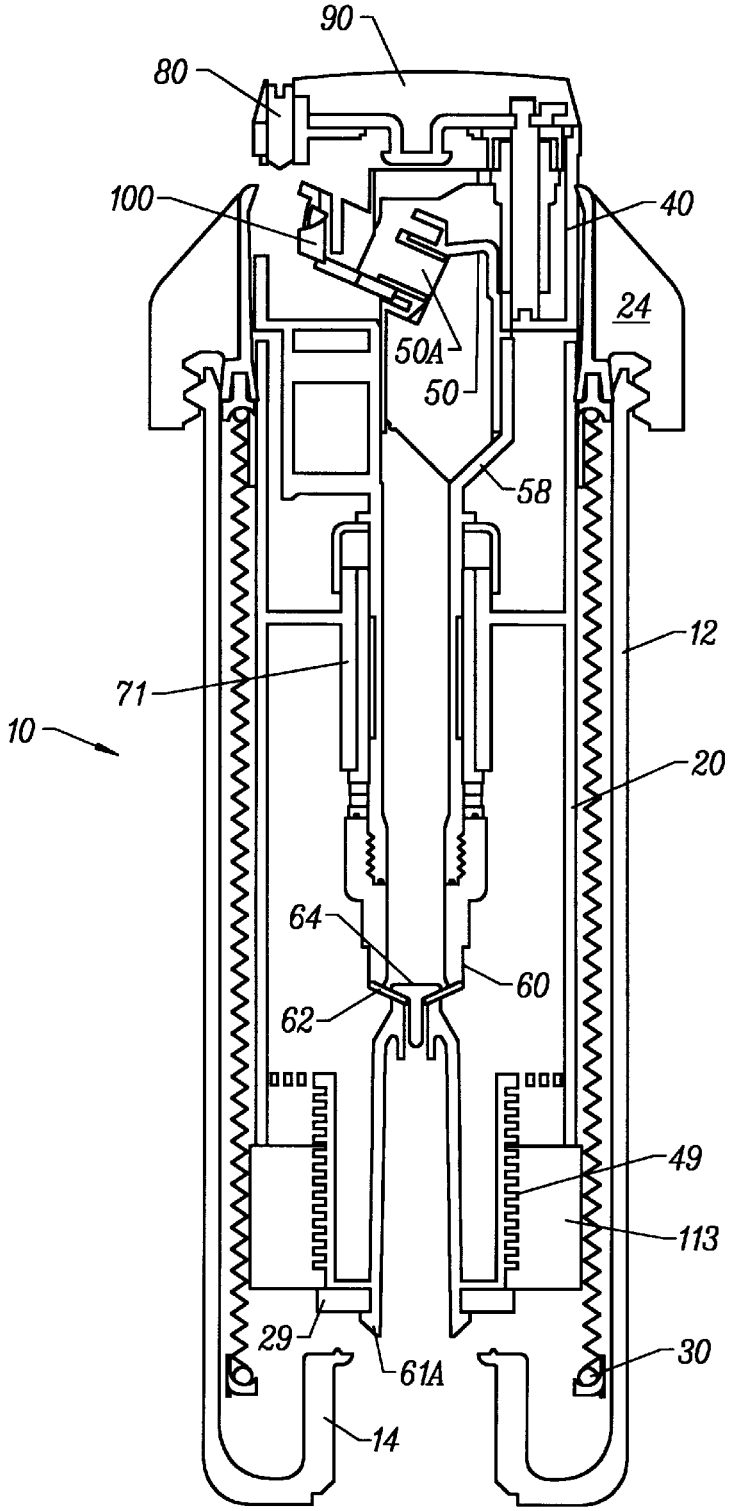
FIG. 4 is a cross-sectional view of the embodiment shown in FIG. 3 in the slightly open position.

FIG. 4 is a cross-sectional elevation view of the sprinkler unit shown in FIG. 1 shortly after pressurized water is supplied thereto at inlet 14. In this view, it is seen that the non-rotating housing 20, together with the filter 49, has moved upwardly within the housing 12. This movement, of course, causes the turret 40 to move upwardly and out of the housing 12. However, it is seen that the internal shut off valve seat 62 remains closed so that water does not flow through the internal conduit of central shaft 44 and the nozzle 52. The valve remains closed inasmuch as the water pressure on the shoulder 48 is substantially the same as on the interior of the valve stem 61. Consequently, the inner housing 20 and the filter 49 move upwardly together. The central hollow shaft 44 is also moved upwardly wherein the valve seat 62 and the inlet cap 60 remain in sealing contact. When the shaft 44 moves upwardly, the turret 40 is also moved upwardly. As seen in FIG. 4, water flow through the sprinkler 10 is prevented by valve seat 62 until turret 40 and the impact arm 100 located therein has cleared out of the outer housing 12. This prevents an inadvertent malfunction of the unit.

Referring now to FIG. 5, there is shown a cross-sectional elevation view of the sprinkler unit 10 after the pressurized water at the inlet 14 is applied and has forced the inner housing 20 out of the outer housing 12. When the water pressure has increased to the point where the guide surface 113 of filter 49 contacts the limit stop surface 25A of retainer 25, the internal valve is opened and water flows freely into shaft 44 and to the nozzle 52. In this situation, the spring 30 is compressed between the spring latches 22 and 25. Thus, the inner housing 20 is biased to move downwardly and back into housing 12 when the water pressure is removed.

In the condition shown in FIG. 5, the water flow path is from inlet 14, through filter 49, through the internal shut off valve (now open), through tube 44, and through the offset channel 58 (which includes vane 77 to reduce turbulence of water passing through nozzle 52).

Figure 6A:
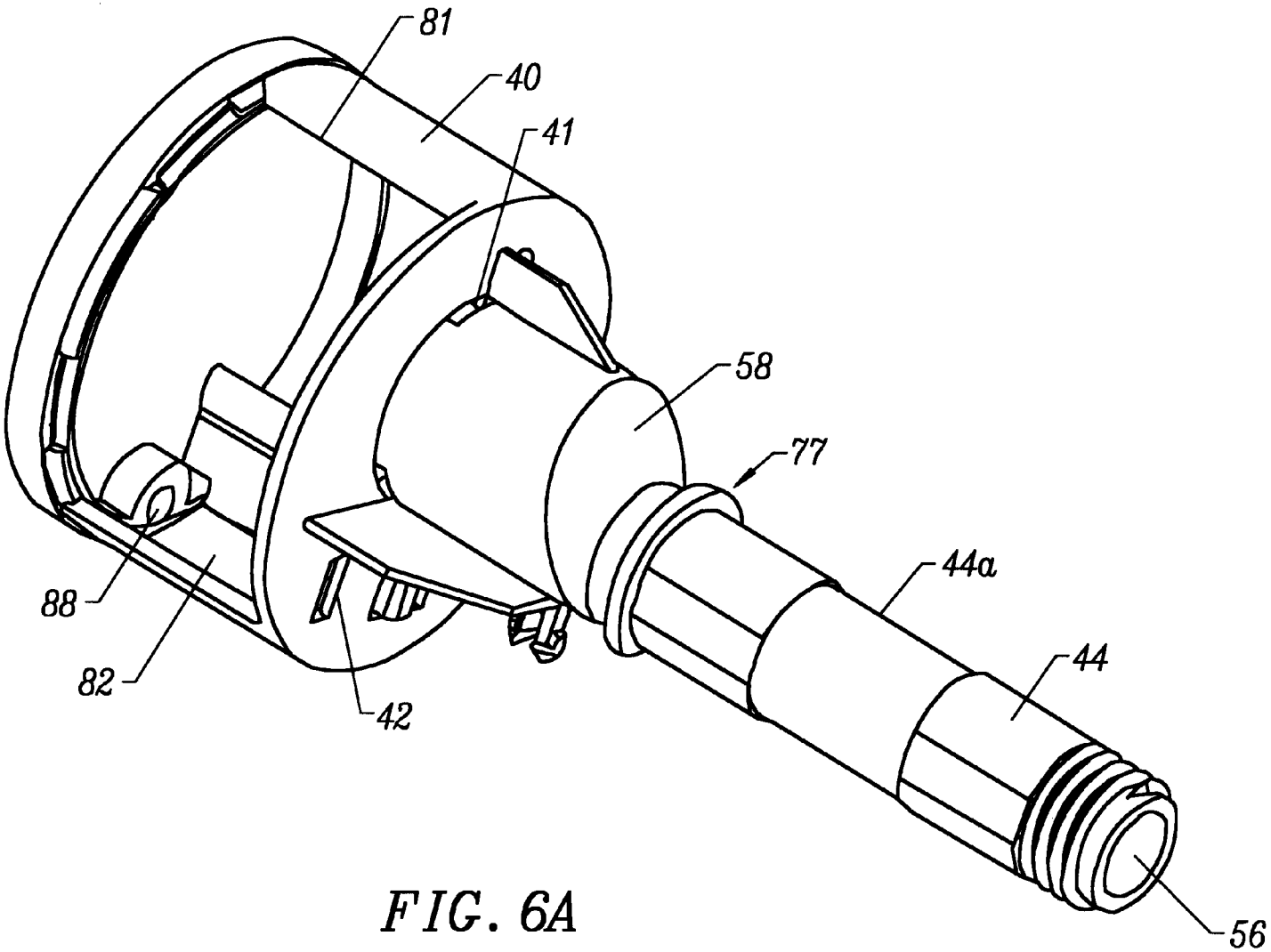
FIGS. 6A, 6B and 6C are an oblique views of the inner shaft and turret assembly.
Figure 6B:
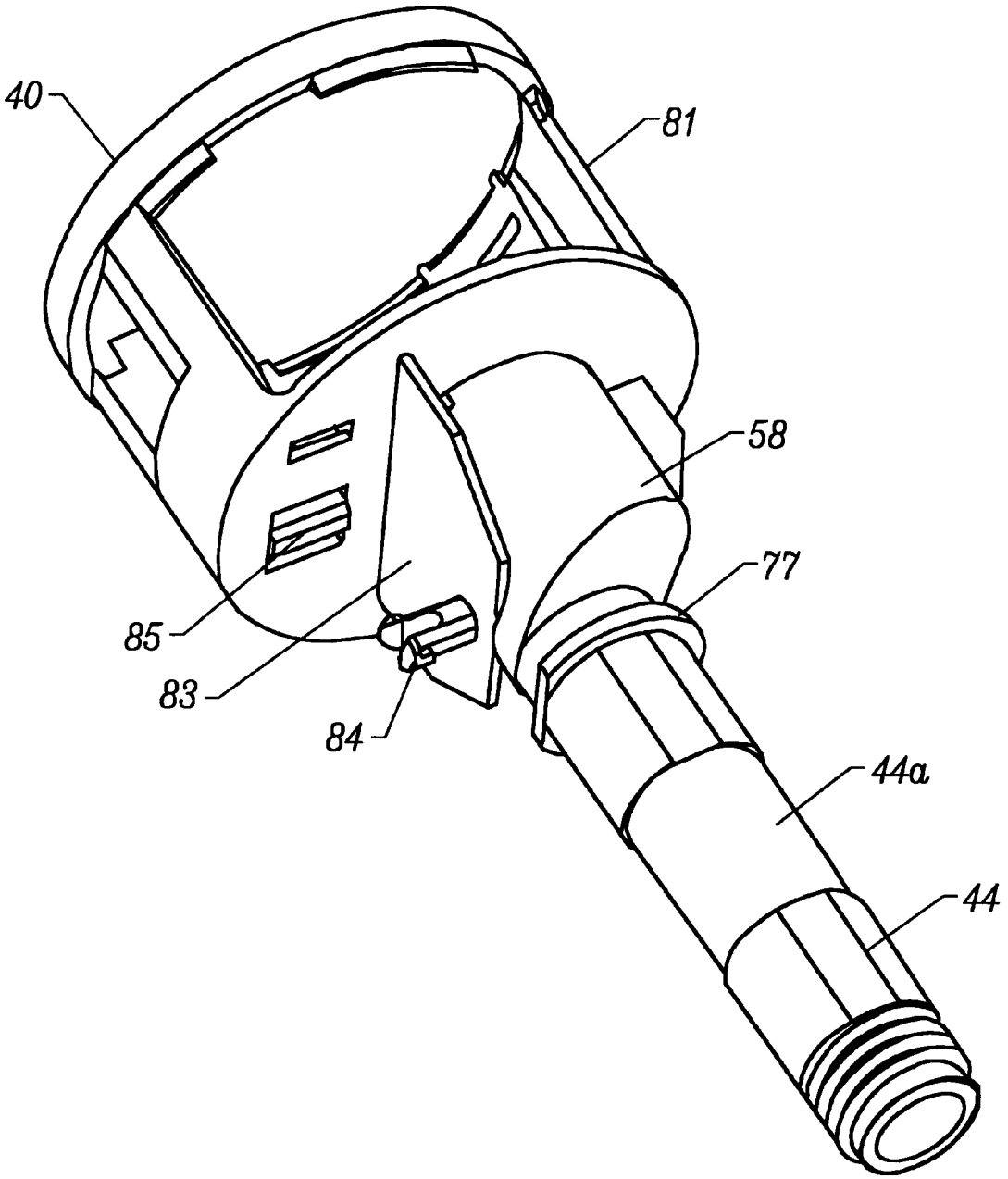
Figure 6C:
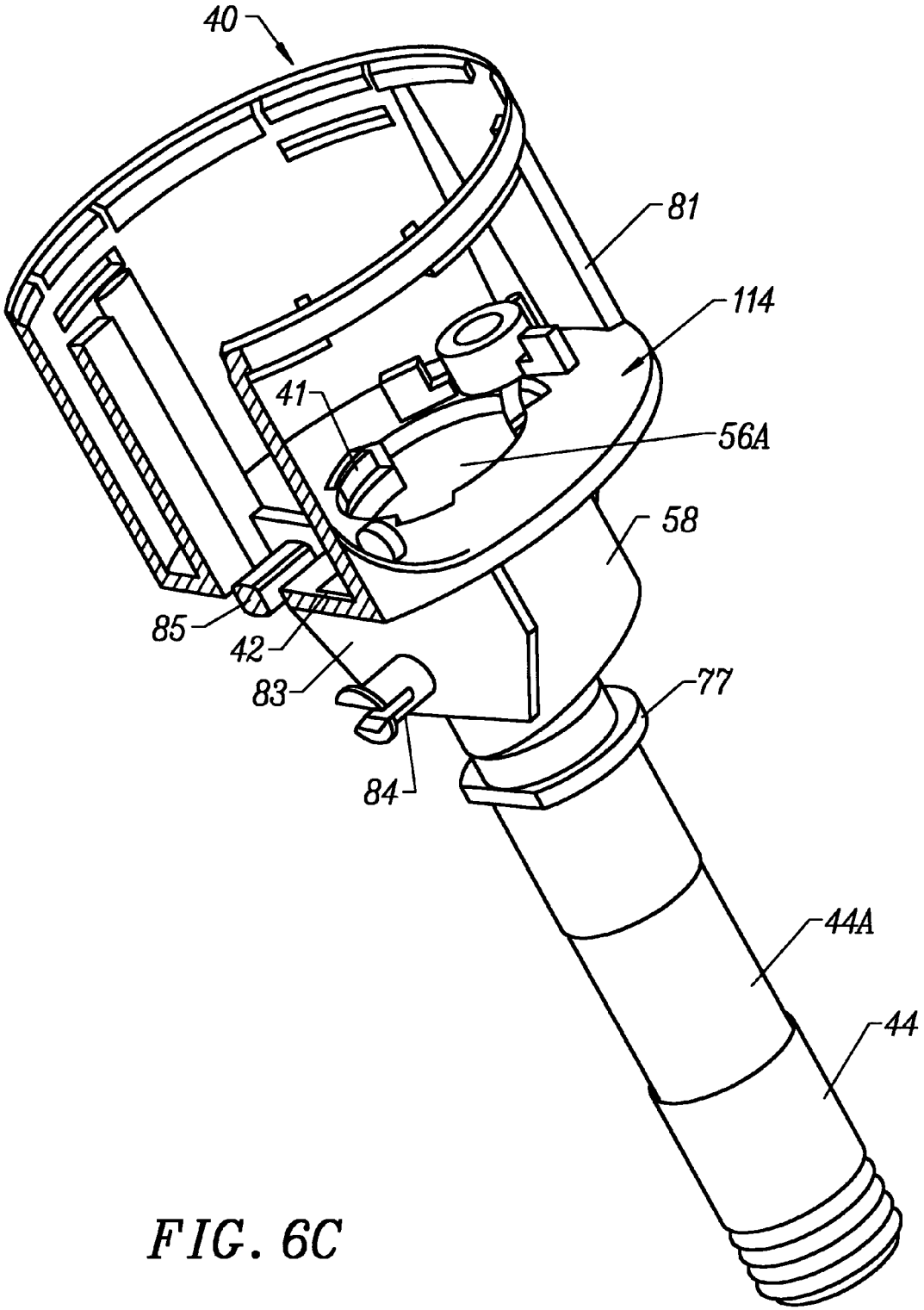

Referring now to FIGS. 6A, 6B and 6C there are shown oblique views of the central shaft 44 and turret 40 which is attached thereto. As previously described, the shaft 44 includes a through bore or conduit 56 for carrying fluids from the inlet 14 of the sprinkler unit 10 to the outlet nozzle 52.

The shaft 44 is generally cylindrical with a reduced portion 44A at approximately the midpoint thereof. The purpose of the reduced diameter portion is to reduce the friction between the bore 44 and the inner housing 20.

A shoulder 77 is provided at the upper portion of the reduced central portion 44A. This shoulder is used to support the bearing 75 described above.

The shaft 44 is joined to the vane housing 58 which is also generally cylindrical but has a tapered lower extremity and, consequently, a somewhat oblong or oval shape at the other end thereof. The upper end of the vane housing 58 is joined to the bottom portion of the turret 40.

Openings 41 in the bottom of the housing 40 (only one of which is shown in FIG. 6A) are provided in order to receive and engage the locking tabs 51 at the upper end of central shaft 44. Opening 42 is a "window" for the trip dog used in the reversing mechanism described infra.

The turret 40 is substantially cylindrical in configuration with the midpoint thereof axially aligned with the center line of the inlet thread 14 and the conduit 56.

A relatively large opening 81 is formed in the outer surface of the turret 40 and comprises approximately 30% of the outer surface. As will appear subsequently, this opening is arranged to receive the shield 95 of the impact arm 100 of the sprinkler apparatus.

A smaller aperture 82 is located in the outer surface of the housing 40 and is aligned with the center line of the vane housing 58. As will be apparent, the opening 82 is aligned with nozzle 52 so that fluid passing through shaft 44 and exiting the nozzle 52 will pass through opening 82.

A small aperture 88 is provided in the upper surface of turret 40. The aperture 88 is adapted to receive a threaded spray adjusting device (see FIG. 1) which can, typically, take the form of a set screw with a needle-like end or the like.

Referring now to FIG. 6B, there is shown another oblique view of the inner shaft 44 and turret 40 which is attached thereto. This view is rotated slightly relative to FIG. 6A in order to illustrate the interior of turret 40 and portions of the reversing mechanism.

As previously described, the shaft 44 includes a through bore or conduit 56 for carrying fluids from the inlet of the sprinkler unit to the outlet nozzle via opening 56A.

The shaft 44 includes the vane housing 58 which is also generally cylindrical but has a tapered lower extremity for receiving vanes as described hereinafter. The upper end of the vane housing 58 is joined to the bottom portion of the turret 40.

Figure 7B:
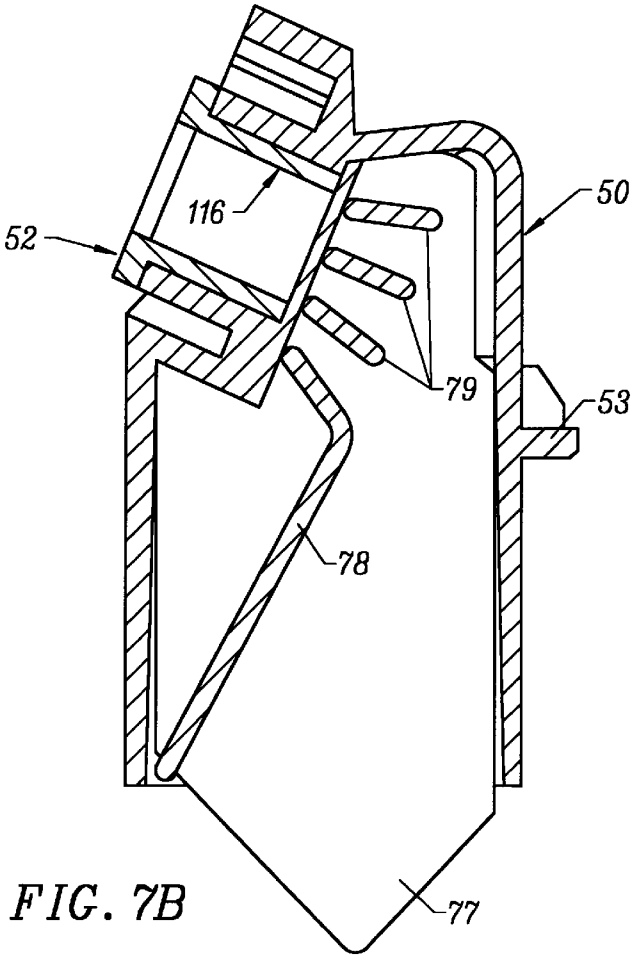
FIGS. 7A and 7B are front elevation and cross-sectional views respectively of the nozzle housing assembly of the instant invention.
Figure 7A:
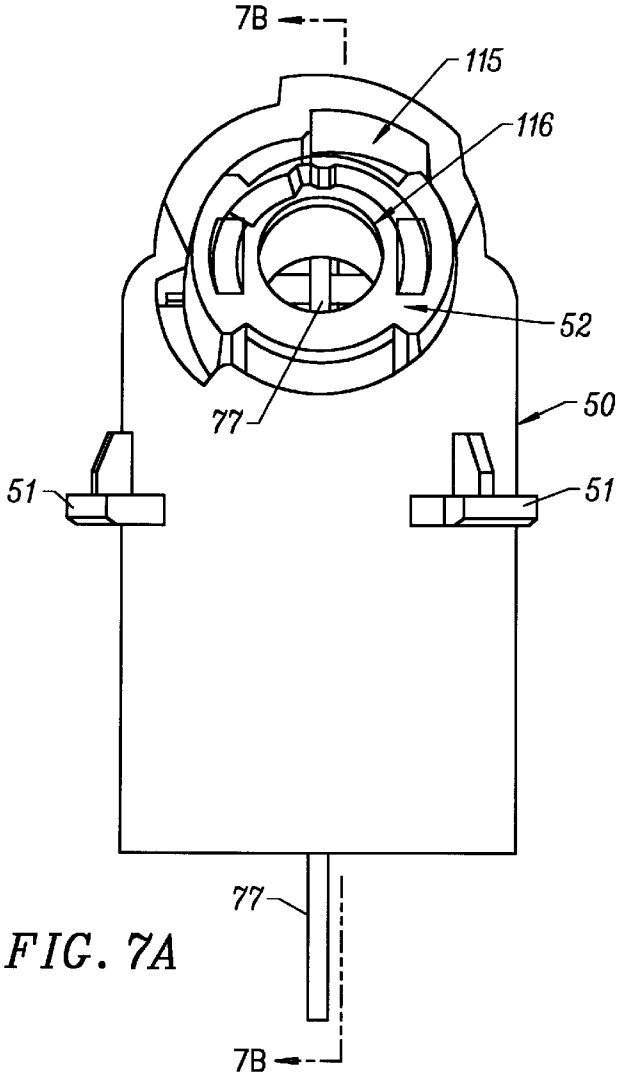

Openings 41 in the bottom of the housing 40 receive and engage the locking tabs 51 at the outer surface of the nozzle assembly 50 (see FIGS. 1, 7A and 7B). The opening 42 for the trip dog is also depicted.

A relatively large opening 81 is formed in the outer surface of the cylindrical housing 40. Opening 81 comprises approximately 30% of the outer surface and is adapted to receive the shield 95 of the impact arm 100. Aperture 82, located in the outer surface of the housing 40 and aligned with the center line of the vane housing 58, is not visible in FIG. 6B.

In FIG. 6B, skirt 83 is provided adjacent to vane housing 58. The housing and the skirt can be integraly formed, if so desired. Pivot pin 84, shown as a split pin, is provided to support the trip actuator (see FIG. 10) for the direction reversing mechanism.

Similarily, pivot pin 85, for supporting the trip dog 87 (see FIG. 10), is provided in bottom surface of turret 40 adjacent to the skirt 83.

Referring now to FIG. 7A, there is shown a front elevation view of the nozzle support assembly 50. This assembly is, generally, cylindrical in configuration. The assembly 50 includes a pair of side tabs 51 which are adapted to engage the openings 41 in the lower surface of housing 40 as shown in FIG. 6.

Referring now to FIG. 7B, there is shown a cross-sectional view of the sprinkler attachment shown in FIG. 7 and taken along the lines A—A of FIG. 7A. The lip 53 at the rear of the head 50 (see FIG. 7A) is similar to the tabs 51 and is adapted to interact with an opening 41 in the lower surface of housing 40 in FIG. 6A.

Referring concurrently to FIGS. 7A and 7B, there is shown a central vane 77 which extends below the lower end of the housing 50 and which conforms to the configuration of the angled end 58 of tube 44. The vane 77 includes a forward wall or surface 78 which is adapted to co-act with the inner surface of housing 50 to form a channel which forces the water or other fluid into the nozzle 52. The wall 78 is angled to create a directional path for the water flowing through tube 44.

Additionally, vanes 79 (three of which are shown in this embodiment) are also formed on the upper end of the vane 77 so as to interact with the wall 78 and the inner surface of housing 50 to effectively reduce turbulence in the water flow through the housing 50 to create a more uniform flow through the nozzle 52. Slot 115 of housing 50 receives bayonet tabs located on the outer surface of nozzle 52.

Figure 12:
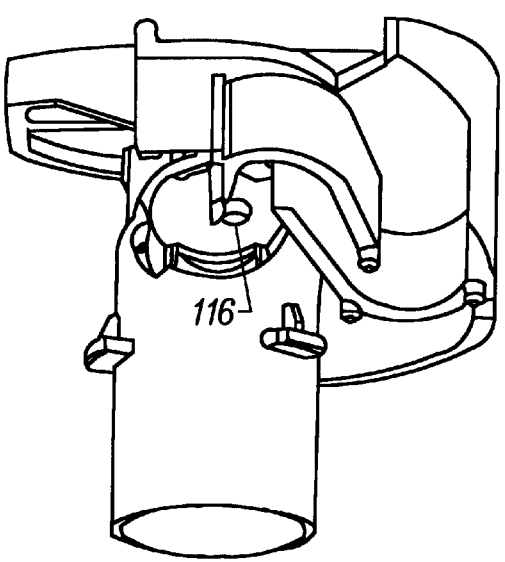
FIG. 12 shows various size nozzles used in the invention.
Figure 12:
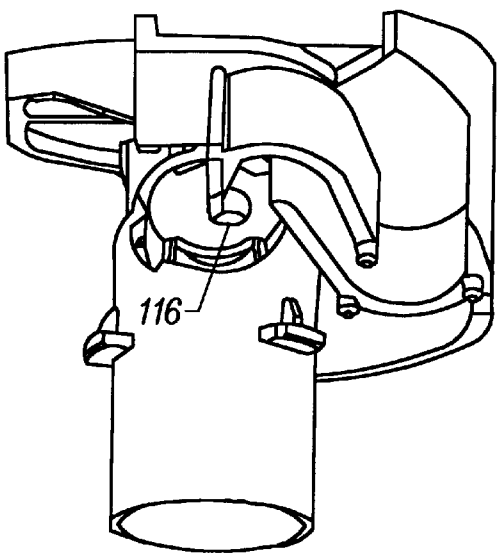
Figure 12:
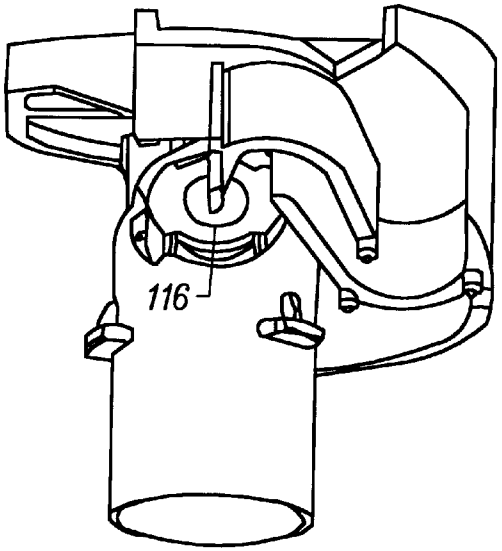

The nozzle 52 is attached to the housing 50 by any suitable means, preferrably by a bayonet type attachment to provide angular alignment of nozzle 52 to arm 100. Nozzle passageway 116 is positioned slightly off center within nozzle 52. The position of passageway 116 varies with nozzle size as shown in FIG. 12.

The offset nozzle passageway 116 (see FIG. 12) directs the nozzle stream into the serpentine passage 99 of arm 100 to a lesser degree in high gallonage, large nozzles, and to a greater degree in low gallonage, small nozzles, thereby controlling the reaction force imparted on the arm 100 by the nozzle stream. This controlled reaction force insures a more uniform rotation speed in sprinklers of differing nozzle sizes for more precise sprinkler distance of throw and application rate.

Figure 8B:
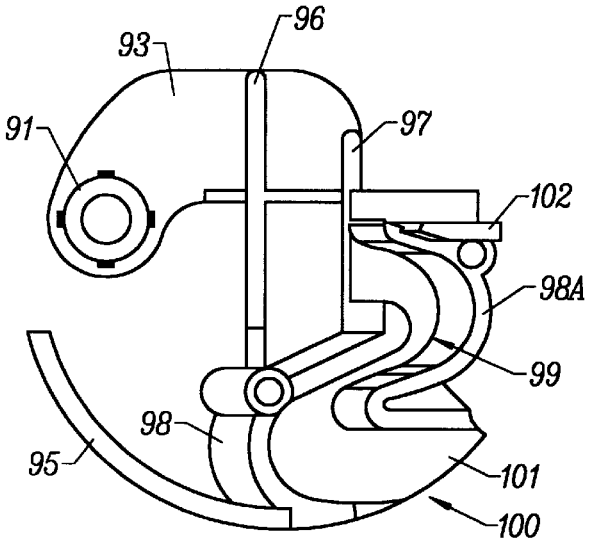
FIGS. 8A through 8D are a plurality of views of the impact arm of the instant invention.
Figure 8A:
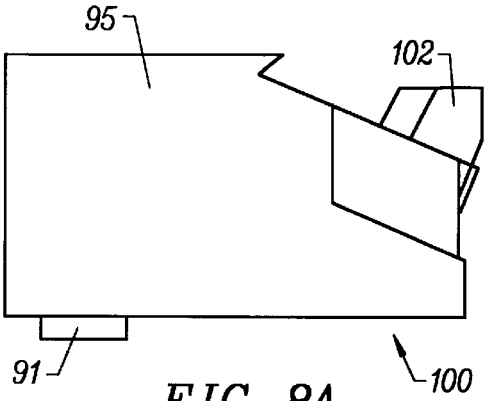

Referring now to FIG. 8A, there is shown one elevation view of the impact arm 100. In this view, the shield 95 is shown adjacent to the fulcrum sleeve bearing 91. As will be seen, the sleeve bearing 91 and the shield 95 are integral portions of the impact arm. The impact arm and sleeve rotate around the fulcrum pin 45 shown in FIG. 11A. The shield 95 is adapted to effectively close the opening 81 in the turret 40 when the sprinkler unit is not operative. The shield 95 is effective to exclude sand, grass and other debris from entering the turret 40. Directional tab 102 extends outwardly from arm 100 and selectively interacts with trip dog 87 as described infra.

Referring now to FIG. 8B, there is shown a partially broken away, interior bottom plan view of the impact arm 100 (i.e. looking upwardly from the inlet end of the unit). In particular, the fulcrum sleeve 91 is a hollow cylinder which is mounted on the fulcrum pin 45 seen in FIGS. 3, 4 and 5. The sleeve is joined to the support arm 93 which is connected to the impact shield 95 by the connecting struts 96 and 97 as well as the arcuate walls 98 and 98A. The serpentine walls 99, together with an upper surface 101 and a lower surface (not shown in FIG. 4) define a serpentine conduit 99 (often referred to as a "PJ" tube) which performs the function previously described.

Figure 8D:
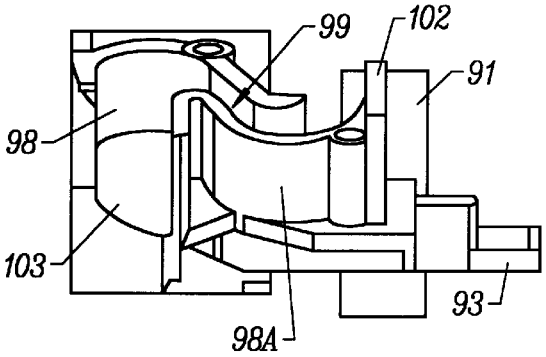
Figure 8C:
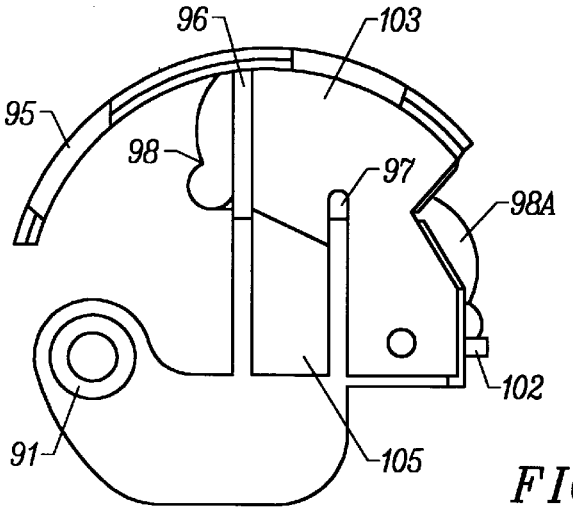

Referring to FIG. 8C, there is shown a top plan view of the impact arm 100. The support arm 93 is joined to the sleeve 91 as well as the struts 96 and 97 as described relative to FIG. 8B. The bottom surface 103 of the serpentine path 99 is, typically, integrally formed with struts 96 and 97. A central opening 105 is shown in FIGS. 8B and 8C. This opening is provided to reduce the wall section of the impact arm for molding as well as to reduce the cost of materials and the like.

Referring to FIG. 8D, there is shown a partially broken away, elevation view of the impact arm 100 rotated by 90° around the centerline thereof relative to FIG. 8A. In FIG. 8D, the serpentine tube 99 is clearly shown as defined by the serpentine walls 98 and 98A together with the lower surface 103. The upper surface 101 is omitted in this view. The sleeve 91 is depicted as joined to the support arm 93. Serpentine path 99 (also referred to as a flow redirection tube) of arm 100 (described infra) interruptively redirects water flow from nozzle 52 to provide a counter rotating moment to sprinkler arm 100 relative to turret 40. Additionally serpentine path 99 provides the necessary time delay to the counter rotating moment to allow arm 100 to re-enter the stream path of nozzle 52 and to impact turret 40 providing a force to intermittently rotate turret 40 relative to inner housing 20 as described infra.

Shield 95 of arm 100 operates to close the opening 81 to prevent debris from entering the sprinkler upper housing area, i.e. turret 40, as it passes the wiper seal lip 19 in the debris contaminated region at the soil surface.

Inner surface 114 of housing 40 is intermittently opened, angled and channeled to further flush out and harmlessly carry away any debris particulates that may bypass the protective shield 95 and wiper seal lip 19. This flushed surface eliminates the debris trap present in prior art designs.

When the water stream from the nozzle 52 strikes the serpentine path 99, arm 100 rotates around the offset fulcrum pin 45. By using the offset fulcrum, the sprinkler unit 10 can have a smaller diameter than the conventional sprinkler which uses a center mounted impact arm.

As the arm 100 is driven rotationally around the fulcrum pin 45, the sprinkler housing 40 is driven first in a clockwise direction until trip adjustable tab 120 interacts with trip actuator leg 86, causing sprinkler 10 to "trip" and change direction. As sprinkler housing 40 rotates in the counter clockwise direction, trip actuator leg 86 contacts fixed trip tab 121 causing sprinkler 10 to "trip" and, again, rotate in a clockwise direction.

It should be noted that the ends of both of the serpentine wall 98, as seen in FIGS. 8B and 8D, is tapered into or shaped into a fairly sharp edge in order to properly interact with the water stream from the nozzle 52.

Figure 9A:
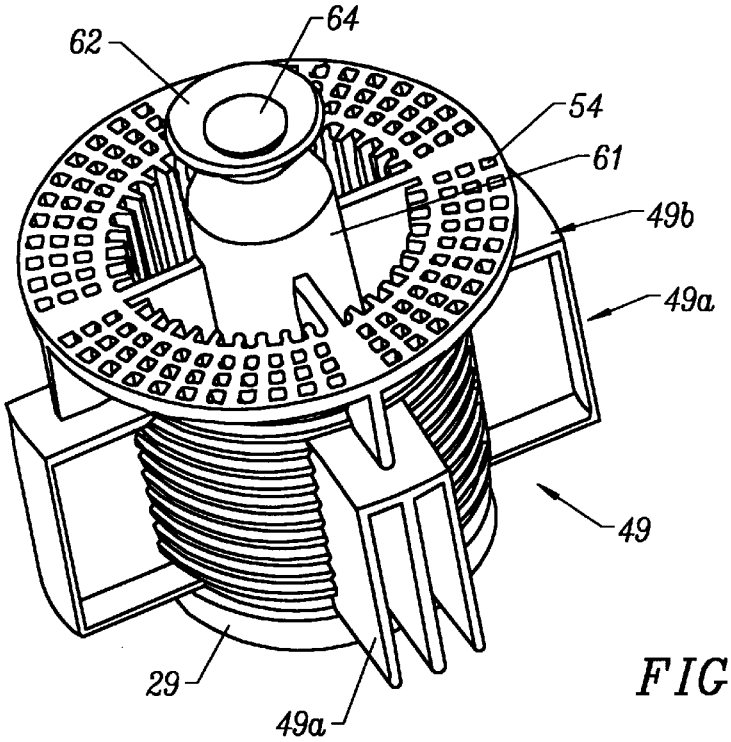
FIGS. 9A and 9B are oblique views of the filter used with the instant invention.
Figure 9B:
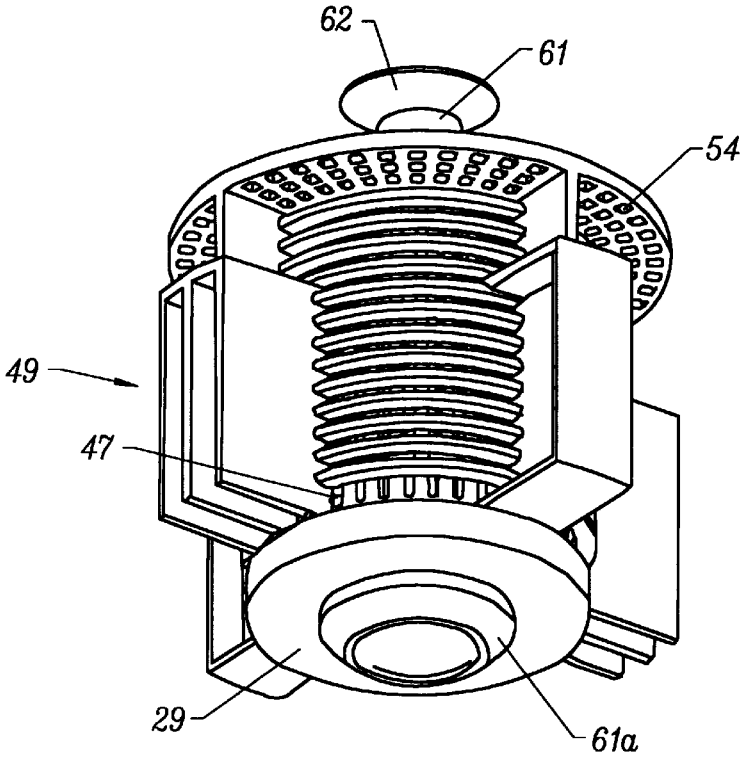

Referring now to FIGS. 9A and 9B, there are shown oblique views of the filter 49 shown in FIGS. 3, 4 and 5. Typically, the filter 49 is formed as a porous, basket-like component with a plurality of openings 47 in the outer surface as well as openings 54 in the upper planar surface. The openings 47 and 54 in the filter are large enough to readily pass water or the like therethrough while filtering out most particulate matter. This action prevents clogging of the nozzle 52 of the sprinkler unit. The filter 49 is readily cleaned, when necessary, by merely removing inner housing 20 from the outer housing 12 and exposing the filter 49.

The valve stem 61 of the filter is shown attached to the filter 49, per se. The reverse flow valve seat 62 is attached to the upper end of the valve stem 61 by the seal retainer 64. The conically shaped valve seat 62 and the valve stem 64 intereact with the inlet cap 60.

The check valve 29 is secured to the lower end of valve stem 61 by the extension 61A, shown as fingers 61A in FIG. 3.

The top surface 49B of filter 49 contacts surface 25A just prior to the inner housing 20 reaching the top of its stroke. Following contact, valve 62 is forced away from inlet cap 60, opening the valve. While the filter 40 is being forced away from the inlet cap 60, it is continuously guided by the sides 49A acting on the guide surfaces 112 of inner housing 20.

Figure 10:
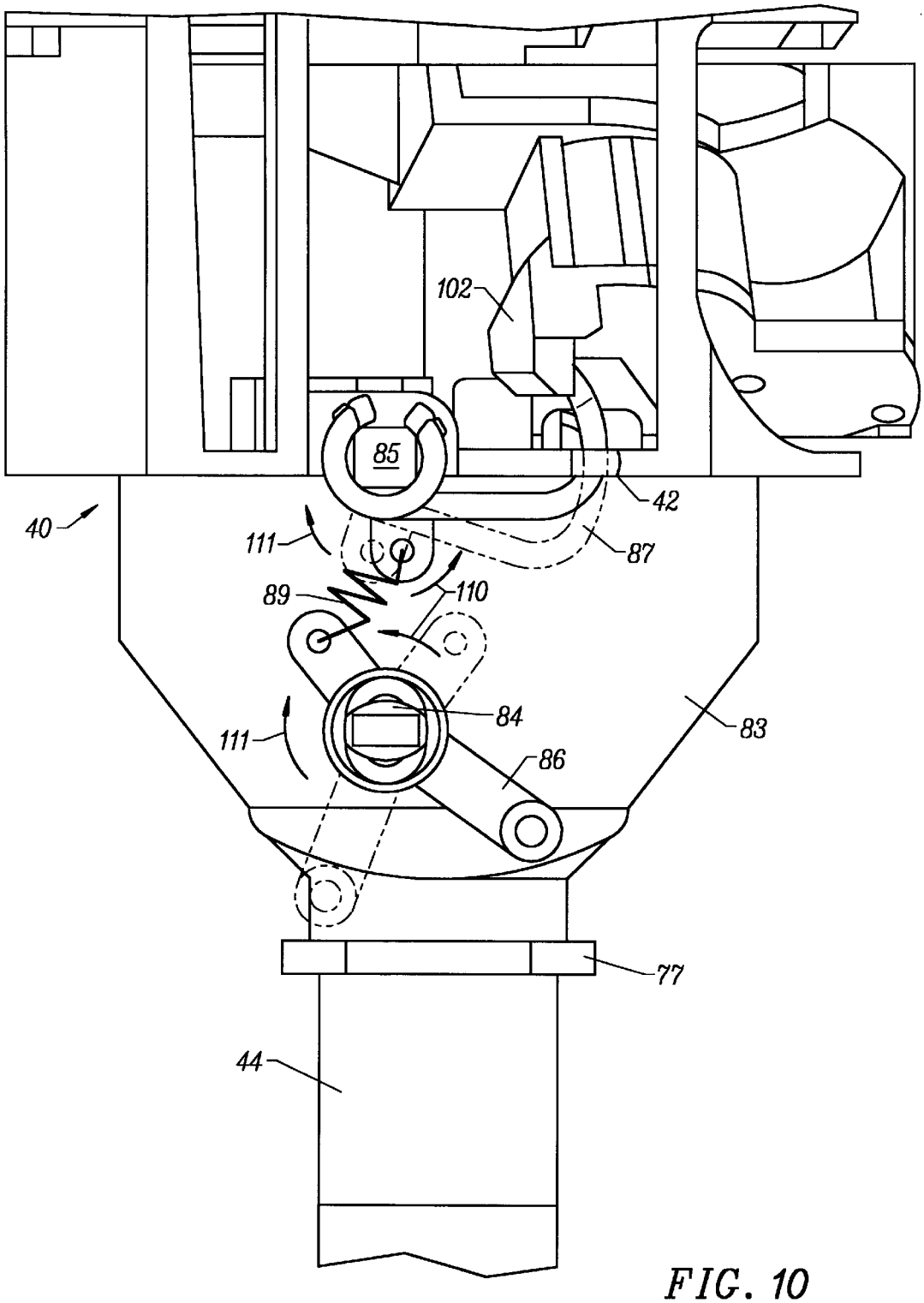
FIG. 10 is a view of the reversing mechanism (in the forward and reverse positions) with a partial view of the turret.

Referring now to FIG. 10, there is shown a partial view of the turret 40 together with a view of the reversing mechanism of the instant invention.

As previously shown in FIG. 6B, the skirt 83 extends downwardly from the bottom of turret 40. The trip actuator 86 is pivotally mounted on the actuator pivot pin 84 while the trip dog 87 is pivotally mounted on trip pivot pin 85. The pivot pins are formed on or with skirt 83. Spring 89, a torsion spring, is connected between adjacent ends of actuator 86 and dog 87.

In operation, the dog 87 and actuator 86 assume two different stable positions as shown by the solid line (position 1) and the dashed line (position 2).

In position 1 the trips are shown in the "sprinkler reverse" condition. The trip mechanism has just finished rotating in the counter clockwise direction shown by the arrows 110. That is, actuator 86 has been rotated counter clockwise causing spring 89 to go "over center" which rotates trip dog 87 counter clockwise into the "sprinkler reverse" position. In position 1, trip dog 87 captures trip tab 102 which is part of sprinkler arm 100.

In position 2, trip actuator has been rotated clockwise causing spring 89 to again go "over center" causing trip dog 87 to rotate clockwise out of engagement with tab 102 of arm 100. In this position of the trip dog, the sprinkler is in the "forward" running condition.

To move from position 1 to position 2, the trip actuator 86 will rotate about pivot pin 84 of turret 40 in the clockwise direction as shown by arrows 111. This action will initially cause trip spring 89 to compress, until it goes "over center". Spring 89 will then expand thereby driving trip dog 87 to the next stable condition in position 2 as shown by the dashed line. It will be noted that the spring 89 is always trying to separate the trip dog lever 87 from the trip actuator lever 86.

The trip adjustable tab collar 120 (see FIG. 11C) will act on the lower arm of the trip actuator 86 to cause the spring to compress and to initiate the switching from position 1 to 2 to 1 etc.

Figure 11A:
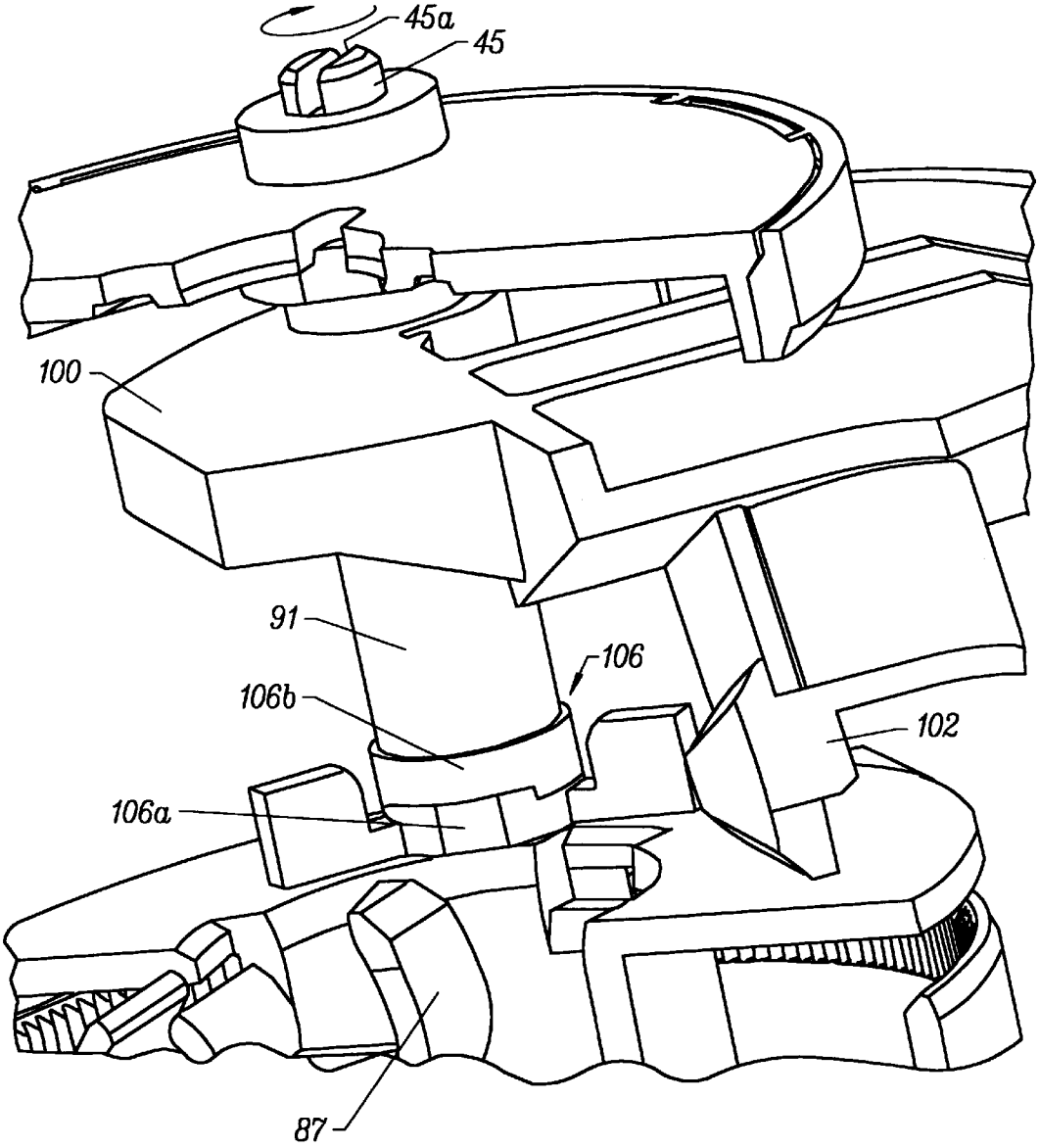
FIGS. 11A, 11B and 11C show a position controller for establishing full-circle or reversible sprinkler operation.
Figure 11B:
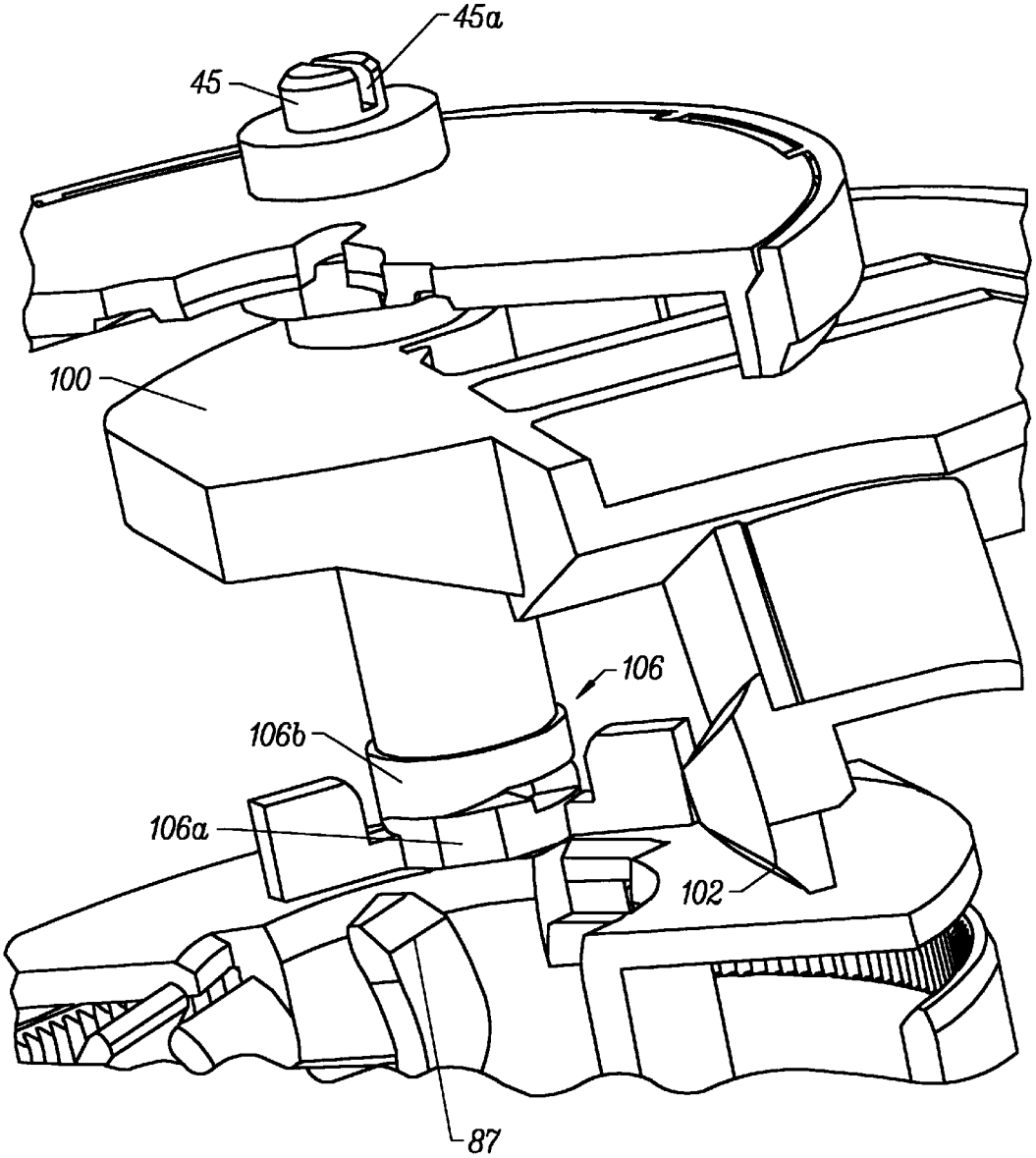
Figure 11C:
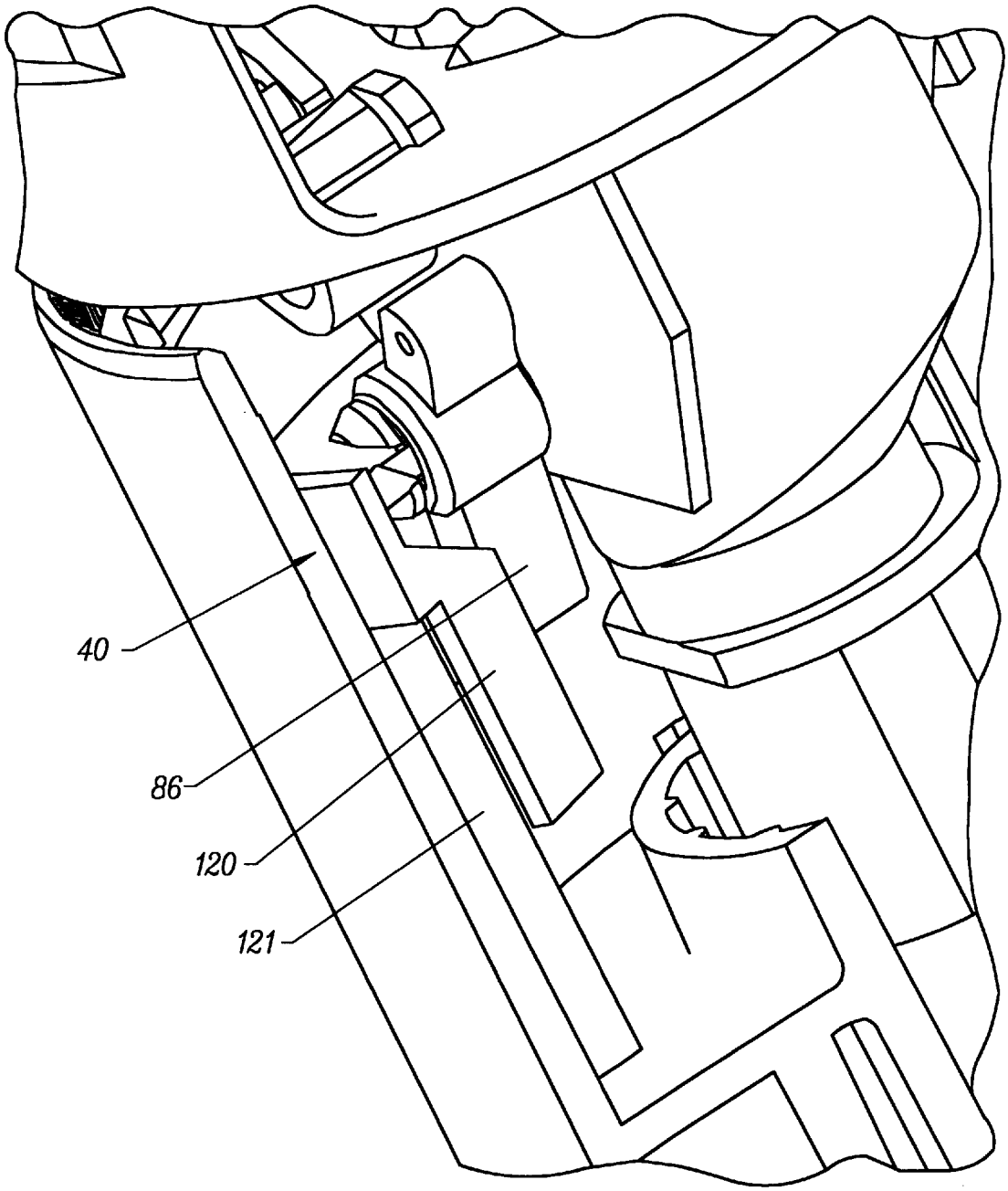

Referring concurrently to FIGS. 11A, 11B and 11C, there is shown a position controller for determing two potential operation conditions of the unit 10, viz. forward/reverse or forward only. During the forward-reverse sprinkler rotation, arm 100 contacts reversing pawl 102 alternately when the sprinkler is to be driven in the reverse directions. That is, arm biasing cam 106 selectively positions arm 100 in one of two axial locations above reversing pawl 102. In position 1 arm 100 is allowed to changably contact reversing tab 102, providing the "part circle" sprinkler operating condition. In position 2 arm 100 is held above the reversing tab 102 by cam 106 such that reversing pawl can no longer contact arm 100, effectively locking sprinkler unit 10 in the "full only" operating condition.

Referring now to FIG. 11A, there is shown a partial view of the components of the turret 40 and, in particular, the adjustment mechnism for converting the sprinkler unit 10 from a partial circle operation to a full circle only operation.

As shown in FIG. 11A, the sprinkler 10 is in the partial circuit configuration. Thus, the trip dog 87 extends through the aperture 42 in the lower surface of turret 40 and is effectived to capture the tab 102 of the impact arm 100 during rotation of the turret 40.

The position of tab 102 is controlled by the position or location of the impact arm 100 as shown in FIG. 11A. In particular, cam 106 includes cam surface 106A which is formed on the inner surface of turret 40 as shown in FIG. 6B. The cam has a circular, inclined plane at the upper surface.

The movable cam plate 106B is attached to the fulcrum Pin 45 and rests on the surface of cam surface 106A. The cam plate 106B has a circular, inclined plane surface which cooperates with the inclined plane surface on the cam surface 106A.

The fulcrum pin 45 extends through the upper surface of turret 40 as well as the covering 90. The fulcrum pin 45 includes a slot 45A in the upper end thereof for easy manipulation thereof by a screw driver or the like.

As shown in FIG. 11A, the fulcrum pin 45 has rotated counterclockwise so that the mating surfaces of the cam surface 106A and the cam plate 106B have achieved the position shown. In this case, the high points of the two cam surfaces are adjacent to each other wherein the cam has attained the least vertical dimension. In this case, the arm 100 is in the position shown wherein tab 102 is capable of engaging trip dog 87.

As shown in FIG. 11B, the fulcrum pin 45 has been rotated counterclockwise. This causes the fulcrum pin to drive the cam plate 106B which is attached thereto in the counterclockwise direction as well. In this case, the inclined planes of the cam surface 106A and cam plate 106B slide relative to each other wherein the high points of the respective cam components are in abutment with each other so that the cam 106 achieves the highest or greatest vertical dimension. Inasmuch as the arm 100 is attached to the fulcrum pin 45 which is raised when the cam operation occurs, the arm 100 is also raised. The distance the arm 100 is raised is designed to be sufficient to prevent tab 102 from engaging trip dog 87 even when the trip dog is in the upright position such as position 1 shown in FIG. 10.

Inasmuch as tab 102 cannot interact with and be restrained by the trip dog, the arm 100 is free to rotate 360° around the fulcrum pin 45 and to produce a full 360° circular spray pattern for the sprinkler 10. Of course, when the partial circle pattern is desired, the fulcrum pin 45 is merely rotated counterclockwise to return the fulcrum pin 45, cam 106 and arm 100 to the position shown in FIG. 11A.

The flow-management arrangement in the preferred embodiment enables the sprinkler unit to selectively provide the flow of water through a selective nozzle for any desired flow control purpose. In the case of pop-up sprinkler units of the type contemplated herein, the sprinkler unit is in the extended or up position when water pressure is applied.

The illustrated invention is a reversible drive sprinkler unit wherein a rotary drive is provided by a significant improvement in the well-known impact arm concept, which drives the sprinkler through a desired arc of coverage. The sprinkler arc may be a full circle or a reversible partial circle with the arc of coverage being adjustable as in other well-known sprinkler units but with an improved control mechanism.

Thus, there is shown and described a unique design and concept of improved impact sprinkler unit. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

We claim:

1. A sprinkler device for fluid distribution comprising, a body including a body inlet portion for receiving the fluid and a body outlet portion, a sprinkler head movably connected to said body and including a sprinkler head inlet portion for receiving the fluid, a nozzle for directing the flow of fluid out the sprinkler head, said nozzle having a nozzle outlet with a nozzle inlet positioned upstream of said nozzle outlet, an interrupter cavity upstream of said nozzle outlet, and drive means for driving said sprinkler head relative to said body, wherein said drive means includes a filter means adjacent to said body inlet portion, a check valve between said filter means and said body inlet portion, and an internal valve defined by said filter means and said sprinkler head inlet portion, wherein said filter means moves relative to said sprinkler head inlet portion.

2. The device recited in claim 1 wherein, said device comprises an impact sprinkler which resides in a closed case.

3. The device recited in claim 2 wherein, said impact sprinkler includes shrouded arm means forming a portion of said closed case.

4. The device recited in claim 1 including, a fulcrum pin located at a rearward portion of said sprinkler head.

5. The device recited in claim 3 wherein, said fulcrum pin is located offset from the center line of said sprinkler head.

6. The device recited in claim 1 including, a nozzle positioning system that allows for uniform speed of rotation of said nozzle.

7. The device recited in claim 1 including, an arm to nozzle positioning system providing uniform rotation speeds under different nozzles at different flow rates.

8. The device recited in claim 1 including, a directional vane adjacent to said nozzle inlet to provide reduced turbulence in said nozzle.

9. The device recited in claim 1 including, slanted and channeled nozzle housing surfaces to flush debris out of said sprinkler head.

10. The device recited in claim 1 including, cam means, and a sprinkler arm positionable in one of two positions, above or below the reversing pawl position, and in line with the reversing pawl, to lock the sprinkler in a full circle or part circle condition.

11. A sprinkler device comprising, an impact sprinkler which resides in a closed case, a body including a body inlet portion for receiving the fluid and a body outlet portion, a sprinkler head movably connected to said body and including a sprinkler head inlet portion for receiving the fluid, a nozzle for directing the flow of fluid out the sprier head, said nozzle having a nozzle outlet with a nozzle inlet positioned upstream of said nozzle outlet, a fulcrum pin located at a rearward portion of said sprinkler head, wherein said fulcrum pin is located offset from the center line of said sprinkler head, a filter means movably mounted adjacent to said body inlet portion, a check valve between said filter means and said body inlet portion, and an internal valve defined by said filter means and said sprinkler head inlet portion for controlling water flow through said body, wherein said filter means moves relative to said sprinkler head inlet portion.

12. The device recited in claim 11 wherein, said short sprinkler arm includes a shrouded arm end selectively forming a portion of said closed case.

13. The device recited in claim 11 including, a directional vane adjacent to said nozzle inlet to provide reduced turbulence in said nozzle.

14. The device recited in claim 11 including, cam means, and a sprinkler arm positionable in one of two positions, above or below a reversing pawl position, respectively, and in line with the reversing pawl, to selectively lock the sprinkler in a full circle or part circle condition.

15. The device recited in claim 1 wherein, said sprinkler head inlet portion includes an internal channel connected to said sprinkler head and axially movable within said body.

16. The device recited in claim 1 wherein, said internal valve includes a valve seat.

17. The device recited in claim 1 including, a spring interposed bewteen said filter means and said body.

* * * * *